US009248460B2

(12) United States Patent
Klimkowski et al.

(10) Patent No.: US 9,248,460 B2
(45) Date of Patent: Feb. 2, 2016

(54) APPARATUS FOR REGULATING TWO-PHASE FLOW AND PORTABLE ATOMIZER BASED ON TWO-PHASE FLOW

(75) Inventors: Jerzy Klimkowski, Warszawa (PL); Miroslaw Krzowski, Marcinkow (PL); Zenon Klimkowski, Warszawa (PL); Zygmunt Lada, Nowa Iwiczna (PL); Jerzy Swiderski, Warszawa (PL)

(73) Assignee: TELESTO SP. Z.O.O., Warszawa (PL)

( * ) Notice: Subject to any disclaimer, the term of this patent is extended or adjusted under 35 U.S.C. 154(b) by 820 days.

(21) Appl. No.: 13/538,201

(22) Filed: Jun. 29, 2012

(65) Prior Publication Data

US 2012/0261495 A1 Oct. 18, 2012

Related U.S. Application Data

(63) Continuation of application No. PCT/PL2011/000001, filed on Jan. 10, 2011.

(30) Foreign Application Priority Data

Jan. 12, 2010 (PL) ..... 390170

(51) Int. Cl.
*B05B 7/04* (2006.01)
*B05B 7/24* (2006.01)
(Continued)

(52) U.S. Cl.
CPC ..... *B05B 7/2427* (2013.01); *A62C 13/68* (2013.01); *B05B 1/3006* (2013.01); *B05B 3/04* (2013.01); *B05B 7/1272* (2013.01); *B05B 7/2421* (2013.01); *B05B 1/3026* (2013.01)

(58) Field of Classification Search
USPC ..... 239/339
See application file for complete search history.

(56) References Cited

U.S. PATENT DOCUMENTS 3,802,511 A * 4/1974 Good, Jr. ..... 169/30
5,623,995 A * 4/1997 Smagac ..... 169/30
(Continued)

FOREIGN PATENT DOCUMENTS

EP 0135219 3/1985
EP 1072320 1/2001
(Continued)

OTHER PUBLICATIONS

International Search Report for corresponding International Application No. PCT/PL2011/000001, mailed on May 5, 2011.

*Primary Examiner* — Len Tran
*Assistant Examiner* — Adam J Rogers
(74) *Attorney, Agent, or Firm* — Myers Wolin, LLC

(57) ABSTRACT

A mixing chamber formed in a chassis outfitted with separate inlet channels for conveying pressurized liquid phase and gaseous phase and an outlet channel linking the mixing chamber with a spray nozzle via a flow tube. A separate cylindrical packing chamber is formed in the chassis, within which packing chamber a rotor with vanes is set, the vanes of which rotor intermittently close the inlet channels of the two phases formed in separate sectors of said packing chamber as demarcated by the rotor vanes, wherein the gaseous phase inlet channel is closed alternately with at least one liquid phase inlet channel conveying liquid phase into the mixing chamber via open inter-vane channels, wherein also the sector of the packing chamber containing the gaseous phase inlet channel is separated from the mixing chamber by a continuous section of a partition that closes off the rotor's inter-vane channels within this sector.

11 Claims, 3 Drawing Sheets

(51) Int. Cl.

| | |
|---|---|
| ***A62C 13/68*** | (2006.01) |
| ***B05B 1/30*** | (2006.01) |
| ***B05B 3/04*** | (2006.01) |
| ***B05B 7/12*** | (2006.01) |

(56) References Cited

U.S. PATENT DOCUMENTS

| | | | | |
|---|---|---|---|---|
| 6,113,004 | A * | 9/2000 | Steingass et al. | 239/152 |
| 6,991,362 | B1 * | 1/2006 | Seaman | 366/168.2 |
| 8,133,328 | B2 * | 3/2012 | Delaney et al. | 134/167 R |
| 2010/0006670 | A1 | 1/2010 | Bourrilhon et al. | |

FOREIGN PATENT DOCUMENTS

| | | |
|---|---|---|
| EP | 1908526 | 4/2008 |
| WO | 95/24274 | 9/1995 |
| WO | 00/12177 | 3/2000 |

* cited by examiner

APPARATUS FOR REGULATING TWO-PHASE FLOW AND PORTABLE ATOMIZER BASED ON TWO-PHASE FLOW

CROSS REFERENCE TO RELATED APPLICATIONS

The present application is a continuation of International Application No. PCT/PL2011/000001, filed on Jan. 10, 2011, which claims priority to PL390170, filed on Jan. 12, 2010, the contents of each of which are incorporated herein by reference.

FIELD OF THE INVENTION

The subject of the invention is an apparatus for regulating two-phase flow and a portable atomizer based on two-phase flow intended for the spraying of liquids for fire extinguishing as well as for chemical agents used in disinfecting, inactivating, deodorizing and deactivating harmful substances for use with atomizers equipped with a vessel for holding a liquid phase and a source of a pressurized gaseous phase.

BACKGROUND

Portable fire extinguishers based on two-phase flow, consisting of a vessel containing a liquid phase interconnected to a source of pressurized gaseous phase and a head assembly with a shut-off valve and a discharge nozzle, are well known. Upon infusing gaseous phase into the liquid phase and releasing the shut-off valve, both phases begin to flow through the unit's head or some other intermediate element to the discharge nozzle. The gaseous phase is usually carbon dioxide, nitrogen or compressed air. Water or other liquids having fire-extinguishing capabilities, at times with the addition of a foaming agent, are used as the liquid phase. A vessel containing pressurized gaseous phase, located either inside or outside the vessel holding liquid phase, constitutes the source of the gaseous phase. The gaseous phase is introduced via a gas tube immersed in the liquid phase vessel near the inlet of the flow tube. Following an increase of pressure inside the vessel containing the liquid phase both phases are forced through the flow tube to the nozzle assembly, wherein mixing of the two phases takes place during the continuous flow of the gaseous phase. The disadvantage of these solutions is that the relative amount of phase mixture content is variable and the pressure and flow rate fall rapidly during the discharge cycle, and this causes flow perturbations and gradual deterioration of fire extinguisher performance.

Well known too are liquid atomizers equipped with a vessel containing a liquid phase interlinked via a gas valve to a gaseous phase vessel, where the gaseous and the liquid phases are delivered to a mixing chamber via separate conduits, and the mixing chamber is next connected to a spray nozzle via a singular flow tube.

Patent publication EP 1197245 depicts a portable foam extinguisher equipped with a pistol-shaped nozzle assembly connected via a mixing chamber to a tank holding liquid phase and a source of gaseous phase. Upon opening the gas valve, liquid phase is forced into the mixing chamber wherein a stream of liquid collides with a stream of gas arriving via a gas tube from the gaseous phase source. Next both phases are transported via a flow conduit executed in the unit's head to the spray nozzle. Additional accessories are used to adjust the relative proportion of gaseous and liquid phases delivered to the mixing chamber. This design allows the generation of a two-phase flow in the mixing chamber and the transfer of the two-phase mixture under pressure to the spray nozzle, where the fire-suppression agent undergoes expansion. This extinguishing device is designed to operate under a working pressure in the range from 25 to 35 bar.

Patent application WO 9524274 presents a device to extinguish fires wherein a two-phase flow is generated in a mixing chamber. Upon introduction of both phases into the chamber, a plug flow wherein portions of the gaseous and liquid phases remain separate, is generated in a conduit connecting the mixing chamber with the nozzle. This device allows for the generation of a dispersed stream of liquid at the nozzle exit with the streamed discharge featuring pulsation-like characteristics. In the technical field of patent application WO9524274, devices to generate two-phase flows with a prescribed relative proportion of gaseous phase in the liquid phase are presented, within which a system of metering valves or manipulators open and close on an interchanging basis the supply conduits of phases into the mixing chamber. This requires fast transport of the gaseous phase intermixed in the liquid phase. Use of such phase interchangers based upon pulsating flows is limited to fixed systems working at a pressure which is constant and for which the pressure differential between the phases remain limited, or to those having an external source of power driving the manipulator.

SUMMARY

The purpose of the present invention is to provide an apparatus for regulating two-phase flow in portable atomizers of liquids for use as portable hand-held fire extinguishers and other sprayers, which are supplied by their own self-contained sources of pressurized gaseous phase.

The apparatus for regulating two-phase flow in atomizers of liquids, comprised of a mixing chamber formed in a chassis outfitted with separate inlet channels for conveying pressurized liquid phase and gaseous phase and an outlet channel linking the mixing chamber with a spray nozzle via a flow tube, is characterized according to the invention by a separate cylindrical packing chamber formed in the chassis where a rotor with vanes is set. The rotor vanes intermittently close the inlet channels of both phases formed in separate sectors of the packing chamber as demarcated by the rotor vanes, wherein the gaseous phase inlet channel is closed alternately with at least one liquid phase inlet channel conveying liquid phase into the mixing chamber via open inter-vane channels. Furthermore, the sector of the packing chamber that contains the gaseous phase inlet channel is separated from the mixing chamber by a continuous section of a partition that closes off the rotor's inter-vane channels within this sector.

It is preferred that the rotor has from 3 to 7 vanes, wherein each vane has a hollowed-out cavity sloped in the direction of the packing chamber sidewall and facing the gaseous phase inlet channel.

It is also preferred that an equilibration channel is formed in the packing chamber sidewall at the same height as the cavities.

It is preferred that the rotor is set between the base of packing chamber, within which at least one liquid phase inlet channel is formed, and between the partition which separates the packing chamber from the mixing chamber, within which partition at least one flow aperture is formed.

It is preferred that each liquid phase inlet channel is formed in the base of the packing chamber at an oblique angle to the surface plane of the vanes.

It is also preferred that the inlet channels of the two phases are situated at an oblique angle to the surface plane of the vanes.

The portable atomizer based on two-phase flow, consisting of a liquid phase vessel, a source of pressurized gaseous phase, and an apparatus for regulating two-phase flow as in claim 1, the apparatus of which includes a mixing chamber formed in a chassis having separate inlet channels for conveying pressurized liquid phase and gaseous phase and an outlet channel linking the mixing chamber with a spray nozzle via a flow tube, wherein the gaseous phase inlet channel is connected with the source of gaseous phase via a gas tube, is characterized according to the invention by a separate cylindrical packing chamber formed in the chassis where a rotor with vanes is set. The rotor vanes intermittently close the inlet channels of both phases formed in separate sectors of the packing chamber as demarcated by the rotor vanes, wherein the gaseous phase inlet channel is closed alternately with at least one liquid phase inlet channel conveying liquid phase into the mixing chamber via open inter-vane channels. Furthermore, the sector of the packing chamber containing the gaseous phase inlet channel is separated from the mixing chamber by a continuous section of a partition that closes off the rotor's inter-vane channels within this sector. Moreover, the chassis is situated inside the liquid phase vessel and the gas tube situated in the liquid phase vessel has a number of small orifices in its wall.

In preferred version of the atomizer the gas tube is connected to an internal source of gaseous phase that is comprised of a container holding gaseous phase which is located inside the liquid phase vessel.

In another version of the atomizer the gas tube is connected to an external source of gaseous phase that is comprised of a container holding gaseous phase which is situated outside the liquid phase vessel.

It is also preferred version of the atomizer in that the gas tube is connected to an internal source of pressurized gaseous phase that is created in the void above the liquid phase surface within the liquid phase vessel, where the void volume constitutes a container holding gaseous phase.

Thanks to the use of a rotor to regulate the flow of the two phases, the liquid phase is brought to the mixing chamber alternately with the gaseous phase, and from there via a singular flow conduit to the spray nozzle or to an array of such nozzles connected together via fittings, from which subsequently a pulsating discharge takes place. The suitable mutual arrangement of individual elements of the apparatus enables for the creation of an extinguishing agent in the form of water mist or foam featuring very good extinguishing qualities. Moreover, the usage of a rotor causes a prolongation of the atomizer operating time and generates a stable spray of dispersed liquid phase throughout the entire cycle of gaseous phase expansion.

The solution according to the invention lends itself for use in various types of fire extinguishers equipped with a pressure vessel for holding liquid phase and a separate pressure vessel for gaseous phase; in fire extinguishers with a single pressure vessel used simultaneously to hold the sources of liquid and gaseous phases—where the void volume over the surface of the liquid constitutes the location for holding compressed gas; in fire extinguishers where the gaseous phase is stored in a pressurized cartridges; and likewise in hand-held sprayers of water-based chemical agents, of water mist, fire-suppressing foam and other fire-extinguishing agents.

BRIEF DESCRIPTION OF THE FIGURES

The subject of the invention is shown in an example of its embodiment in the attached drawing, in which.

DETAILED DESCRIPTION

Figure 1:
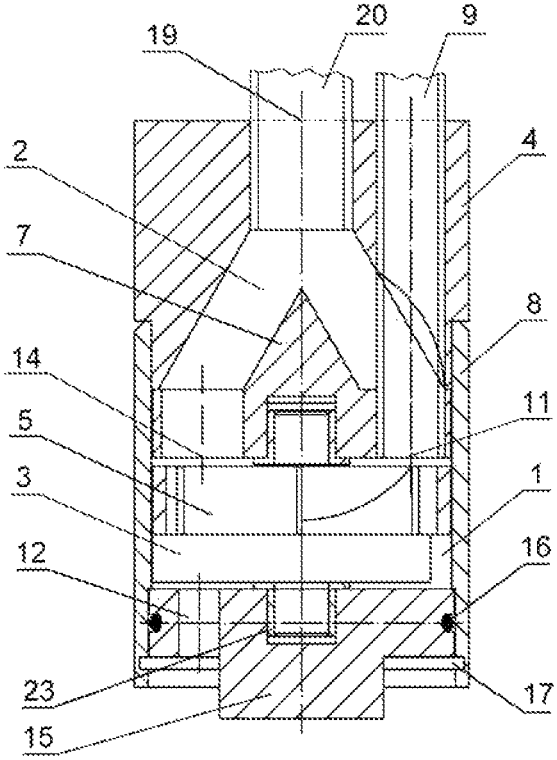
FIG. 1 depicts the axial -section of the device for regulating two-phase flow.

As shown in FIG. 1, the apparatus for regulating two-phase flow has a mixing chamber 2 in a chassis 8 equipped with separate inlet channels for conveying pressurized liquid phase and gaseous phase. In the upper part 4 of the chassis 8 is formed an outlet channel 19 linking the mixing chamber with a spray nozzle via a flow tube 20. Below the mixing chamber 2 there is a cylindrical packing chamber 1 in the chassis 8 within which a rotor 3 with vanes 5 is set, the vanes of which intermittently close the inlet channels of the two phases.

These inlet channels are formed in separate sectors of the packing chamber 1 as demarcated by the rotor vanes 5, wherein the gaseous phase inlet channel 11 is closed alternately with at least one liquid phase inlet channel 12 that is conveying liquid into the mixing chamber 2 via open inter-vane channels. Furthermore, the section of the packing chamber 1 containing the gaseous phase inlet channel 11 is separated from the mixing chamber 2 by a continuous section of a partition 7 that that closes off the rotor's (3) inter-vane channels within this sector. Beyond this sector, the partition 7, which separates the packing chamber 1 from the mixing chamber 2, has flow apertures 14 connecting the inter-vane channels of the rotor 3 with the mixing chamber 2. This partition 7 may be made as a separate piece or formed in one operation together with the top part 4 of the chassis 8.

The rotor 3 has from 3 to 7 vanes 5 and is set between the packing chamber base 15 and the partition 7. The packing chamber base 15 has formed within it at least one liquid phase inlet channel 12. In the instance where a single liquid phase inlet channel 12 is formed, this channel is shifted in the rotor's axial plane by 180 degrees with respect to the gaseous phase inlet channel 11. Sockets 23 for seating the rotor's 3 pins are made in the center of the base 15 and the partition 7. The base is attached separately in the chassis 8 by the use of a snap ring 17 and sealed around the perimeter using a ring gasket 16. A flange in the chassis 8 below the expansion ring 17 permits the installation of a strainer used in water-based fire extinguishers.

Figure 2:
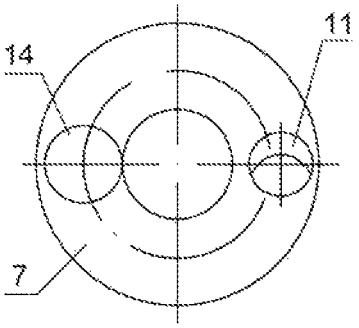
FIG. 2 shows a top view of the partition between the mixing chamber and the packing chamber with one flow aperture.

The partition 7 shown in FIG. 2 has one flow aperture 14 and one gaseous phase inlet channel 11 which are situated opposite to each other with respect to the rotation axis of the rotor 3. The gaseous phase inlet channel 11 is formed in a continuous section of the partition 7 at an oblique angle to the surface of the vanes 5 in a direction that converges towards the direction of rotation of the rotor 3.

Figure 2A:
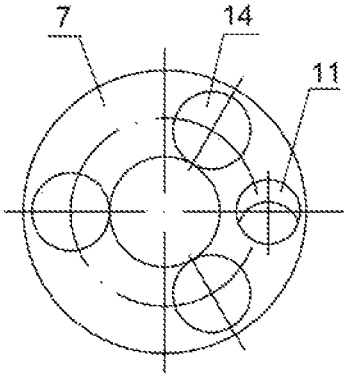
FIG. 2*a* shows the partition in top view with three flow apertures between the mixing chamber and the packing chamber.

The version of the partition 7 shown in FIG. 2*a* has three flow apertures 14 spaced evenly with respect to the rotation axis of the rotor 3, as well as a gaseous phase inlet aperture 11 which is situated between two of the flow apertures 14, wherein the gaseous phase inlet aperture 11 is formed at an oblique angle in a continuous section of the partition 7.

Figure 3:
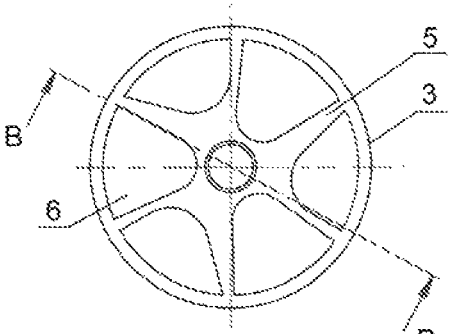
FIG. 3 shows a top view of the rotor with its hollowed out cavities.

The rotor 3 shown in FIG. 3 has three vanes 5, each of which features a hollowed-out cavity 6 sloped in the direction of the packing chamber sidewall 1 and facing the gaseous phase inlet channel 11.

Figure 4:
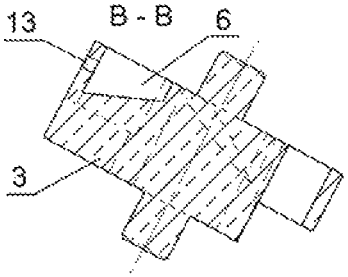
FIG. 4 shows a B-B cross section of the FIG. 3 rotor with its cavities.

As shown in FIG. 4, when the rotor cavities 6 are oriented in the direction of the partition 7 they are facing the gaseous phase inlet channel 11, whereas in the direction of the packing chamber sidewall 1 they have an equilibration aperture 13 that is located at the same height as the equilibration channel 18 formed in the chassis 8. Usage of an equilibration channel 18 and equilibration aperture 13 allows for a lessening of the difference in pressures between the gaseous and liquid phases conveyed into the packing chamber 1 and by the same token allows for stabilization of rotor 3 rotations.

Figure 5:
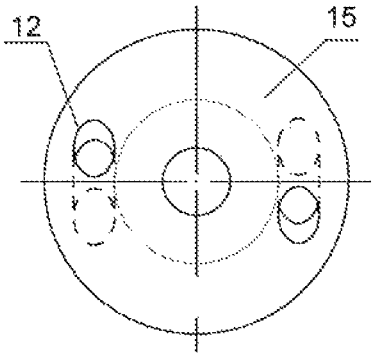
FIG. 5 shows a top view of the packing chamber base with two inlet channels.

The base 15 shown in FIG. 5 has liquid phase inlet channels 12 spaced evenly with respect to the rotor's 3 rotation axis, wherein these liquid phase inlet channels 12 are positioned at an oblique angle to the surface of the vanes 5 and oriented in the direction of the rotation of the packing chamber 1 rotor 3. In cases where there is only one liquid phase inlet channel 12 in the base 15, the liquid phase inlet channel 12 is situated opposite the gaseous phase inlet channel 11 with respect to the axis of rotation of the rotor 3.

Figure 6:
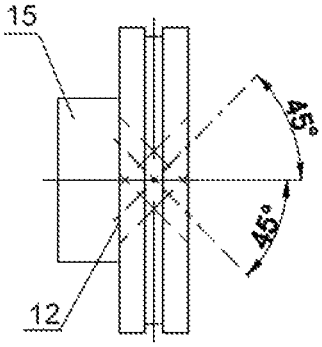
FIG. 6 shows a side view of the packing chamber base from FIG. 5.

As shown in FIG. 6, the angle of incline of the liquid phase inlet channel 12 axes with respect to the surface of the base 15 is approximately 45 degrees. This angle may vary from 30 degrees to 60 degrees depending on the desired design value for the axial flow velocity of the liquid.

Figure 7:
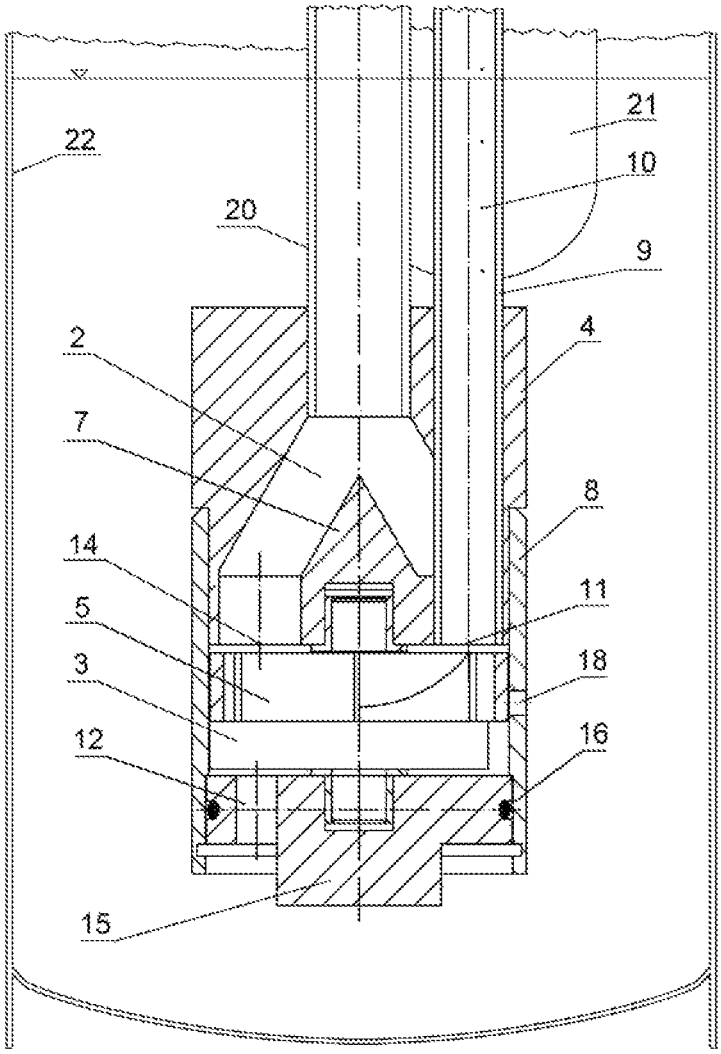
FIG. 7 shows a section of a liquid phase vessel that contains a separate container for gaseous phase and an apparatus for regulating the two-phase flow, FIG. 8 schematically presents a hand-held atomizer containing a separate internal container for holding gaseous phase.

As shown in FIG. 7, the portable hand-held atomizer based on two-phase flow features an apparatus for regulating two-phase flow connected via a gas tube 9 to an internal source of gaseous phase which is a gaseous phase container 21 placed inside the liquid phase vessel 22. The chassis 8 of the apparatus is situated inside the liquid phase vessel 22 beneath the surface of the liquid phase, whereas the gas tube 9 is attached to the gaseous phase inlet channel 11. Furthermore, the gas tube 9 has a number of small orifices 10 in its tube wall to allow the outflow of gaseous phase into the liquid phase vessel 22. The diameter of these orifices 10 is significantly smaller that the diameter of the gas tube 9. The apparatus for regulating two-phase flow has a mixing chamber 2 made in a chassis 8 equipped with separate inlet channels for conveying pressurized liquid phase and gaseous phase and an outlet channel 19 linking the mixing chamber with a spray nozzle via a flow tube 20. The chassis 8 contains furthermore a cylindrical packing chamber 1 within which packing chamber a rotor 3 with vanes 5 is set, the vanes of which rotor intermittently close the inlet channels of the two phases formed in separate sectors of said packing chamber 1 as demarcated by the rotor vanes 5. The gaseous phase inlet channel 11 is closed alternately with at least one liquid phase inlet channel 12 conveying liquid phase into the mixing chamber 2 via open inter-vane channels, wherein the sector of the packing chamber 1 containing the gaseous phase inlet channel 11 is separated from the mixing chamber 2 by a continuous section of a partition 7 that closes off the rotor's 3 inter-vane channels within this sector. An equilibration channel 18 is made in the sidewall of the packing chamber 1 at the height of the equilibration aperture 13, which can be seen in FIG. 4. The angular positioning of the equilibration channel 18 with respect to the gaseous phase inlet channel 11 is determined depending on what performance characteristics are desired for the apparatus.

Figure 8:
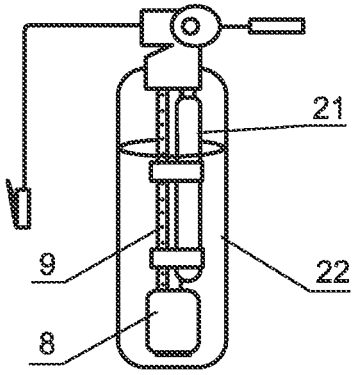
Figure 9:
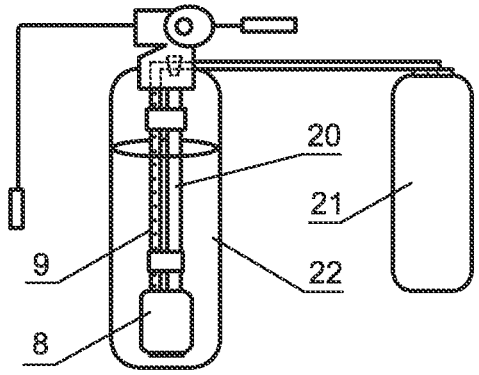
FIG. 9 shows a hand-held atomizer utilizing an externally located container for holding gaseous phase.
Figure 10:
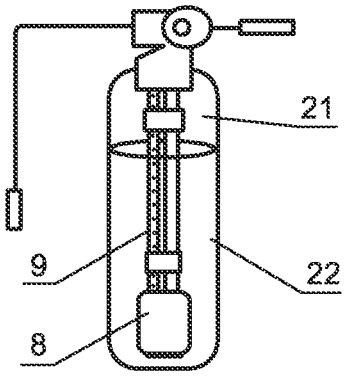
FIG. 10 shows a hand-held atomizer where the void volume above the liquid in the liquid phase vessel serves as internal container for holding gaseous phase.

As shown in FIGS. 8, 9, and 10, the hand-held atomizer has the apparatus for regulating two-phase flow situated inside the liquid phase vessel 22 wherein, depending on which implementation is desired, the source of the gaseous phase may be found inside or outside the vessel. In all implementations the gas tube 9 that is situated inside the liquid phase vessel 22 contains small orifices 10 in its wall.

FIG. 8 schematically depicts the atomizer detailed in FIG. 7, in which a separate container 21 holding gaseous phase is situated inside the liquid phase vessel 22. The atomizer is outfitted with a head assembly featuring a grip handle, a spray nozzle and a shut off valve.

FIG. 9 depicts the atomizer outfitted with a source of gaseous phase in a separate container 21 holding gaseous phase located externally to the liquid phase vessel 22.

FIG. 10 presents an implementation where the source of the gaseous phase is created in the void above the liquid phase surface in the liquid phase vessel 22, where the void volume constitutes a container 21 holding gaseous phase. In this implementation the shut-off valve is mounted in the body of the head assembly.

The portable atomizer based on two-phase flow is intended for use in fire extinguishers and other portable atomizers that function under conditions of diminishing operating pressures. The initial value of the operating pressure in fire extinguishers and other hand-held sprayers usually does not exceed 25 bar. Usage in the atomizers of the apparatus for regulating two-phase flow according to this invention insures the generation of a stable stream of dispersed liquid phase during the entire pressure drop process, from its initial value down to the level of atmospheric pressure.

Actuation of the atomizer that is the subject of this invention occurs upon the opening of the shut-off valve installed in the nozzle or head assembly. Compressed gas from the source of the gaseous phase is conveyed by way of a gas tube 9 to the packing chamber 1 of the apparatus for regulating two-phase flow. Orifices 10 in the gas tube wall allow for a gradual equilibration of the differences in pressures. In the implementations where a separate container 21 holding gaseous phase is used, regardless of whether it is located inside or outside of the liquid phase vessel 22, the orifices 10 in the gas tube 9 wall permit the gradual delivery of compressed gaseous phase into the vessel. When the source for the compressed gaseous phase is the void above the liquid surface in the liquid phase vessel 22, where the void volume constitutes a container 21 holding gaseous phase, then the gas tube orifices 10 allow for the gradual transfer of pressurized gaseous phase into the gas tube 9 and then onwards to the packing chamber 1 containing the rotor 3. The flow of both the liquid and gaseous phases through the packing chamber 1 causes the rotor 3 to rotate. Portioning of phases, liquid phase alternately with gaseous phase, along with its conveyance via the mixing chamber 2 to the flow tube 20 occurs during rotations of the rotor 3.

We claim:

1. An apparatus for regulating two-phase flow in atomizers of liquids that includes a mixing chamber (2) formed in a chassis (8) having separate inlet channels for conveying pressurized liquid phase and pressurized gaseous phase and an outlet channel (19) linking the mixing chamber with a spray nozzle via a flow tube (20), characterized in that a separate cylindrical packing chamber (1) is formed in the chassis (8), within which packing chamber a rotor (3) with vanes (5) is set, said rotor vanes intermittenly close the inlet channels of the two phases formed in separate sectors of said packing chamber (1) as demarcated by the rotor vanes (5), wherein the gaseous phase inlet channel (11) is closed alternately with at least one liquid phase inlet channel (12) conveying liquid phase into the mixing chamber (2) via open inter-vane channels; wherein also the sector of the packing chamber (1) containing the gaseous phase inlet channel (11) is separated from the mixing chamber (2) by a continuous section of a partition (7) that closes off the rotor's (3) inter-vane channels within this sector.

2. The apparatus in accordance with claim 1, wherein the rotor (3) has from 3 to 7 vanes (5), and each of the vanes (5) has a hollowed-out cavity (6) sloped in the direction of the packing chamber (1) sidewall and facing the gaseous phase inlet channel (11).

3. The apparatus in accordance with claim 2, wherein an equilibration channel (18) is formed in the sidewall of the packing chamber (1) at the same height as the cavities (6).

4. The apparatus in accordance with claim 1, wherein e rotor (3) is set between the packing chamber (1) base (15), within which at least one liquid phase inlet channel (12) is formed, and between the partition (7) which separates the packing chamber (1) from the mixing chamber (2), within which partition (7) at least one flow aperture (14) is formed.

5. The apparatus in accordance with claim 1, wherein each liquid phase inlet channel (12) is formed in the packing chamber (1) base (15) at an oblique angle to the surface plane of the vanes (5).

6. The apparatus in accordance with claim 1, wherein the inlet channels of the two phases are situated at an oblique angle to the surface plane of the vanes (5).

7. A portable atomizer- of liquids based on two-phase flow that includes a liquid phase vessel (22), a source of pressurized gaseous phase, and an apparatus for regulating two-phase flow including a mixing chamber (2) formed in a chassis (8) having separate inlet channels for conveying pressurized liquid phase and pressurized gaseous phase and an outlet channel (19) linking the mixing chamber (2) with a spray nozzle via a flow tube (20), wherein the gaseous phase inlet channel (11) is connected with the source of gaseous phase via a gas tube (9), characterized in that a separate cylindrical packing chamber (1) is formed in the chassis (8), within which packing chamber a rotor (3) with vanes (5) is set, said rotor vanes intermittenly close the inlet channels of the two phases formed in separate sectors of said packing chamber (1) as demarcated by the rotor vanes (5), wherein the gaseous phase inlet channel (11) is closed alternately with at least one liquid phase inlet channel (12) conveying liquid phase into the mixing chamber (2) via open inter-vane channels; wherein also the sector of the packing chamber (1) containing the gaseous phase inlet channel (11) is separated from the mixing chamber (2) by a continuous section of a partition (7) that closes off the rotor's (3) inter-vane channels within this sector, and furthermore, the chassis (8) is situated inside the liquid phase vessel (22) and the gas tube (9) situated in the liquid phase vessel has a number of small orifices (10) in its wall.

8. The portable atomizer in accordance with claim 7, wherein the gas tube (9) is connected to an internal source of gaseous phase that is comprised of a container (21) holding gaseous phase which is situated inside the liquid phase vessel (22).

9. The portable atomizer in accordance with claim 7, wherein the gas tube (9) is connected to an external source of gaseous phase that is comprised of a container (21) holding gaseous phase which is situated outside the liquid phase vessel (22).

10. The portable atomizer in accordance with claim 7, wherein the gas tube (9) is connected to an internal source of pressurized gaseous phase that is created in the void above the liquid phase surface within the liquid phase vessel (22), where the void volume constitutes a container (21) holding gaseous phase.

11. An apparatus for regulating two-phase flow in atomizers of liquids that includes a mixing chamber (2) formed in a chassis (8) having separate inlet channels for conveying pressurized liquid phase and pressurized gaseous phase and an outlet channel (19) linking the mixing chamber with a spray nozzle via a flow tube (20), characterized in that a separate cylindrical packing chamber (1) is formed in the chassis (8), within which packing chamber a rotor (3) with vanes (5) is set, said rotor vanes intermittently close the inlet channels of the two phases formed in separate sectors of said packing chamber (1) as demarcated by the rotor vanes (5), wherein the gaseous phase inlet channel (11) is closed alternately with at least one liquid phase inlet channel (12) conveying liquid phase into the mixing chamber (2) via open inter-vane channels; wherein also the sector of the packing chamber (1) containing the gaseous phase inlet channel (11) is separated from the mixing chamber (2) by a continuous section of a partition (7) that closes off the rotor's (3) inter-vane channels within this sector, wherein the rotor (3) has from 3 to 7 vanes (5), and each of the vanes (5) has a hollowed-out cavity (6) sloped in the direction of the packing chamber (1) sidewall and facing the gaseous phase inlet channel (11) and an equilibration channel (18) is formed in the sidewall of the packing chamber (1) at the same height as the cavities (6), and wherein the rotor (3) is set between the packing chamber (1) base (15), within which at least one liquid phase inlet channel (12) is formed, and between the partition (7) which separates the packing chamber (1) from the mixing chamber (2), within which partition (7) at least one flow aperture (14) is formed.

* * * * *